United States Patent [19]

Grey

[11] Patent Number: 4,604,819

[45] Date of Patent: Aug. 12, 1986

[54] IMITATION MEDAL

[75] Inventor: George E. Grey, Mount Dandenong, Australia

[73] Assignee: Craigave Pty. Ltd., Mt. Dandenong, Australia

[21] Appl. No.: 639,447

[22] Filed: Aug. 10, 1984

[30] Foreign Application Priority Data

Aug. 23, 1983 [AU] Australia ..... PG0984

[51] Int. Cl.[4] ..... A44C 3/00

[52] U.S. Cl. ..... 40/1.5; 40/1.6

[58] Field of Search ..... 40/1.5, 1.6; 446/26, 446/27; 63/2, 20

[56] References Cited

U.S. PATENT DOCUMENTS 2,336,184 12/1943 Mitchel ..... 40/1.5
2,339,364 1/1944 Thomas ..... 40/1.5
2,340,402 2/1944 Mitchel ..... 40/1.5
2,451,913 10/1948 Brice ..... 40/1.5
3,086,268 4/1963 Chaffin, Jr. ..... 119/106

FOREIGN PATENT DOCUMENTS 886098 11/1971 Canada ..... 40/1.6

*Primary Examiner*—Robert P. Swiatek
*Assistant Examiner*—Cary E. Stone
*Attorney, Agent, or Firm*—Sheridan Neimark; Karl W. Flocks

[57] ABSTRACT

An imitation medal including a pair of plastic casing parts arranged together to give an appearance of a unitary medal having a pair of spaced apart outer faces which can be decorated or inscribed. An internal cavity is defined between the casing parts, and a weighted member is located within the cavity. The weighted member gives the medal an appreciable weight.

11 Claims, 4 Drawing Figures

IMITATION MEDAL

This invention relates generally to medals and in particular to imitations thereof. The medals may be particularly applicable as awards for excellence, such as in sporting events, and it will be convenient to hereinafter describe the invention in relation to that application. It is to be appreciated, however, that the medals of the invention are not limited to that exemplary application.

It is well known to provide medals as awards for sporting excellence, particularly in amateur sports. Those medals are sometimes mounted in a box and other times attached to a ribbon or mounted on a stand. Usually a pictorial representation of the sport the medal represents is depicted on one face of the medal with provision being made for particulars of the medal recipient on the other face.

In the past, these medals have been made of metal by casting or forging therefrom. However, that is now becoming expensive, particularly for amateur sporting organisations requiring large numbers of medals on frequent occasions.

It is an object of the present invention to alleviate this problem through the provision of a relatively inexpensive imitation medal.

With that in mind, the present invention provides a medal, including: a pair of casing parts composed of plastic material and arranged together to give an appearance of a unitary medal having a pair of spaced apart outer faces on which the medal can be decorated, the arranged casing parts defining an internal cavity therebetween; and, a weighted member located within the cavity thereby to give the medal an appreciable weight.

Preferably, one of the casing parts has a generally planar wall with an integral upstanding rim extending thereabout so as to define a shallow recess between the wall and rim. The wall preferably has an outer face which forms one outer face of the medal. Preferably, the rim has opposed inner and outer faces, the latter face defining the peripheral edge face of the medal.

Preferably, the other casing part also has a generally planar wall which is constructed so as to extend over the shallow recess and engage with the rim of the one casing part to close the recess and thereby form the cavity. Preferably, when assembled, the other casing part will extend generally parallel to and spaced from the wall of the one casing part. This other casing part preferably has an outer face which forms the other outer face of the medal.

Preferably, the casing parts are releasably assembled. That releasability will allow the other casing part to be replaced or interchanged as desired. Assembly between the casing parts is preferably achieved by shaping and sizing the casing parts so that the other casing part press fits within the rim of the one casing part with the peripheral edge face of the other casing part interferingly engaging the inner face of the rim. Preferably, when so assembled, the other casing part is generally located between the rim and does not generally outstand therefrom.

Preferably, the weighted member is a weighted plate removably locatable within the cavity. That weighted plate is preferably shaped and sized relative to the cavity so that it does not rattle or is not otherwise detectable as being separate from the casing parts of the medal. Preferably, the weighted plate at least substantially entirely fills the cavity defined by the casing parts.

The following description refers to a preferred embodiment of the various features of the imitation medal of the present invention. To facilitate an understanding of the invention, reference is made in the description to the accompanying drawings where the medal is illustrated in that preferred embodiment. It is to be understood that the medal of the present invention is not limited to the preferred embodiment as hereinafter described and illustrated in the drawings.

Figure 1:
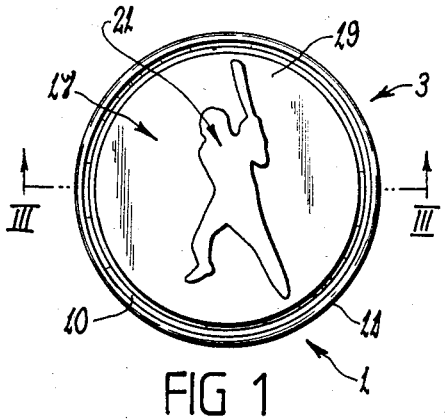
FIG. 1 is a top plan view of a preferred embodiment of the imitation medal of the present invention.
Figure 2:
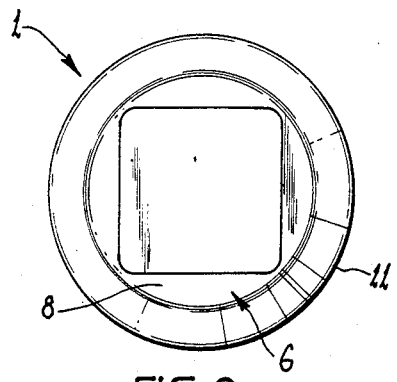
FIG. 2 is a bottom plan view of the medal of FIG. 1.
Figure 3:
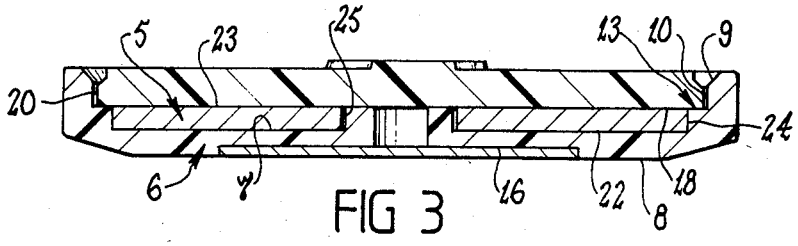
FIG. 3 is a side view of the medal through section III—III of FIG. 1; and, FIG. 4 is an exploded or unassembled perspective view of the medal of FIG. 1.
Figure 4:
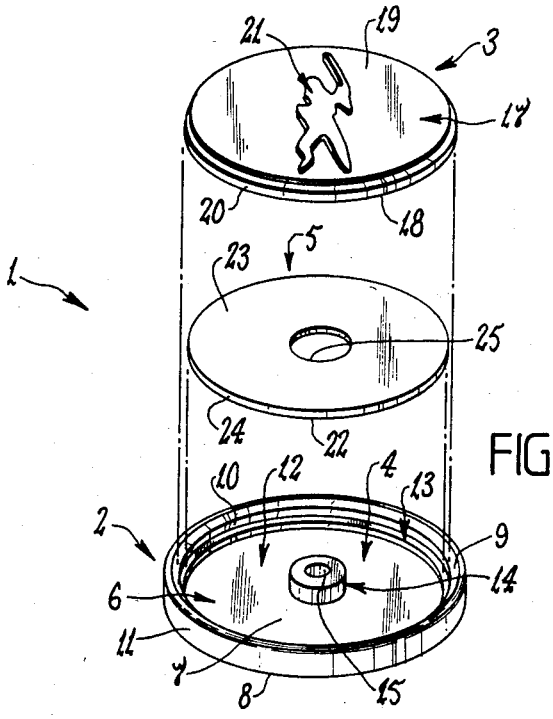

Referring to the drawings there is generally illustrated imitation medal 1, comprising a pair of plastic casing parts 2,3, assembled together so as to define internal cavity 4, therebetween, with weighted metal plate 5, encased by casing parts 2,3, within internal cavity 4.

Casing part 2, includes planar wall 6, having inner and outer faces 7,8, respectively, outer face 8, providing a back face of medal 1. Casing part 2, also has peripheral rim 9, extending about planar wall 6, and upstanding from inner face 7. Rim 9, has spaced inner and outer faces 10,11, outer face 11, providing a peripheral edge face of medal 1. Inner face 7, of wall 6, and inner face 10, of rim 9, together define shallow recess 12, opening from casing part 2. Outer faces 8, and 11, of casing part 2, may be decoratively rendered as desired according to the intended application of the medal.

Casing part 2, is constructed to facilitate assembly of casing part 3, thereto and also positive location of weighted plate 5, therein. To that end, shoulder 13, is provided with recess 12, at the juncture between inner faces 7, and 10, to assist in that assembly and location as will become more apparent hereinafter. Shoulder 13, may extend continuously, non-continuously or intermittently about rim 9.

Casing part 2, also includes location post 14, for weighted plate 5, upstanding from inner face 7, of planar wall 6, into recess 12. That location post 14, is conveniently positioned centrally of recess 12.

Casing part 2, may further include access aperture 15, extending through planar wall 6, from outer face 8, and opening into recess 12. As illustrated, that aperture 15, may extend coaxially through location post 14. This aperture 15, is arranged to receive an elongate tool (not illustrated) therethrough to press against casing part 3, and push casing part 3, out of engagement with casing part 2, to disassemble casing parts 2,3, as desired.

Outer face 8, of planar wall 6, is adapted to receive an information plate (not illustrated) containing particulars of the medal recipient. Conveniently, that plate will overlie to hide access aperture 15, and in that regard, outer face 8, may be recessed as at 16, to receive and properly locate the plate.

Casing part 3, includes planar wall 17, having inner and outer faces 18,19, respectively and peripheral edge face 20, extending perpendicularly therebetween. Outer face 19, provides a front face of medal 1.

Casing part 3, is shaped and sized so as to be received within rim 9, to close recess 12, and form cavity 4. In that regard, during assembly of casing parts 2,3, casing part 3, can be press fitted into casing part 2, peripheral edge face 20, interferingly engaging with inner face 10, of rim 9, so as to positively secure casing parts 2,3, together. Fitting of casing part 3, into recess 12, is limited to where inner face 18, abuts against shoulder 13, and location post 14, so that planar walls 6, and 17, extend in a parallel closely spaced apart relationship. In this position, outer face 19, lies about level with the top of rim 9.

Outer face 19, of casing part 3, may be decoratively rendered as desired. In that regard, in the example application of the medal, there may appear on outer face 19, a pictorial representation 21, of the sport that the medal is intended to represent. The decoration may be formed in relief on outer face 19.

Casing parts 2,3, may be composed of plastic material using any suitable manufacturing technique. Those casing parts may be separately molded, any decorations of outer faces 8, 11, and 19, being incorporated during that manufacture.

Casing parts 2,3, may be provided with an outer surface finish, at least on all outer faces 8, 11, and 19, which gives imitation medal 1, the appearance of a metal medal. To that end, outer faces 8, 11, and 19, may be provided with a metalised surface coating. That coating may give medal 1, the appearance of any desired metal medal, such as gold, silver, and bronze. The metalised coating may be applied using any suitable metalising technique well known to those skilled in the relevant art, and may be applied to casing parts 2,3, separately or when those parts are assembled together.

Weighted plate 5, has a pair of opposed side faces 22, and 23, and peripheral edge face 24. Weighted plate 5, is shaped and sized relative to cavity 4, so that when in cavity 4, side faces 22,23, each abut respective inner face 7, and 18, of casing parts 2,3, so that weighted plate 5, is generally sandwiched between casing parts 2,3. In addition, peripheral side edge 24, abuts or is located immediately adjacent shoulder 13, and weighted plate 5, has corresponding aperture 25, therein into or through which location post 14, extends. In this way, weighted plate 5, is positively located within cavity 2.

Weighted plate 5, is a metal plate, and may be steel.

Medal 1, may be of a disc-shape as illustrated, although it should be appreciated that other shapes are equally possible. In the example application, medal 1, may be about 55 mm in diameter and about 7 mm thick. That medal 1, may weigh about 40 grams, with more than half that weight, such as 25 grams, being that of plate 5.

Imitation medal 1, may be used as an award or the like simply on its own. Alternatively, medal 1, may be boxed for presentation. In further alternatives, medal 1, may be attached to a ribbon or mounted on a stand and in those alternatives provision may be made for that attachment or mounting. That may be achieved by providing a suitable attachment hook or eye, or mounting apertures (not illustrated) in rim 9, of casing part 2.

An imitation medal according to the present invention is relatively inexpensive to produce and purchase. Despite this, the medal has both the appearance and feel of a genuine metal medal. As such, this imitation medal is an appropriate substitute for metal medals as awards for excellence.

It is to be understood that various modifications and/or alterations may be made to the imitation medal without departing from the ambit of the present invention as defined in the claims appended hereto.

Having now described my invention what I claim as new and desire to secure by Letters Patent is:

1. A medal, including: a pair of casing parts composed of plastic material and assembled together to give an appearance of a unitary medal having a pair of spaced apart outer faces at least one of which is decorated, the casing parts frictionally interengaging each other so as to be assembled together by friction fit, the assembled casing parts defining an internal cavity therebetween; one of the casing parts having a location post projecting into the internal cavity; and, a weighted member located within the cavity to give the medal an appreciable weight, the weighted member having an aperture therein through which the location post closely extends so as to assist positive location of the weighted member within the cavity, and the weighted member being shaped and sized so as to be sandwiched between the friction fitted casing parts and thereby be securely held against rattling within the cavity solely by the casing parts.

2. A medal as claimed in claim 1, wherein the casing parts are releasably assembled together thereby to permit replacement or changing of the casing parts.

3. A medal as claimed in claim 1, wherein the first casing part also has a shoulder within the recess at the juncture of the planar wall and rim thereof, the planar wall of the other casing part abutting the shoulder to locate the planar walls of the casing parts in a parallel, spaced apart relationship.

4. A medal as claimed in claim 1, wherein the weighted member is a weighted plate having a pair of opposed faces, the casing parts abutting respective opposed faces so as to sandwich the weighted plate therebetween.

5. A medal as claimed in claim 4, wherein the weighted plate has a peripheral edge that is closely spaced from the first casing part to assist positive location of the weighted plate within the cavity.

6. A medal as claimed in claim 4, wherein the weighted plate has a peripheral edge that engages the first casing part to assist positive location of the weighted plate within the cavity.

7. A medal as claimed in claim 1, wherein one of the casing parts has a generally planar wall and an upstanding rim extending about the planar wall so that a shallow recess is defined between the planar wall and rim, and wherein the other casing part has a generally planar wall which extends over the shallow recess and engages with the rim to close that recess and form the cavity.

8. A medal as claimed in claim 7, wherein the rim of the one casing part has an inner face, and the planar wall of the other casing part has peripheral edge face extending thereabout, the casing parts being shaped and sized so that the other casing part fits within the rim of the one casing part with the peripheral edge face interferingly engaging the rim inner face to assemble the parts together.

9. A medal, including: first and second casing parts composed of plastic material and assembled together to give an appearance of a unitary medal having a pair of spaced apart outer faces on which the medal can be decorated, said first casing part having a generally planar wall providing one of the outer faces and an inner face, and having an upstanding rim extending about the planar wall with an inner face, the inner faces of the planar wall and upstanding rim together defining a shallow recess therebetween; said second casing part having a generally planar wall providing the other one of the outer faces and an inner face, and having a narrow peripheral edge face extending about the planar wall between the outer and inner faces, the planar wall of the second casing part being located at least substantially within the shallow recess and extending thereover, the peripheral edge face solely frictionally engaging the inner face to assemble the casing parts together solely by friction fit, and the planar wall inner faces of the casing parts being spaced apart to define an internal cavity therebetween; one of the casing parts having a location post projecting into the internal cavity; and a weighted member located within the cavity to give the medal an appreciable weight, the weighted member having an aperture through which the location post closely extends so as to assist positive location of the weighted member within the cavity, and the weighted member being securely held against rattling within the cavity.

10. A medal, including: first and second casing parts composed of plastic material and assembled together to give an appearance of a unitary medal having a pair of spaced apart outer faces on which the medal can be decorated, said first casing part having a generally planar wall with an inner face and having an upstanding rim extending about the planar wall with an inner face, the inner faces of the planar wall and upstanding rim together defining a shallow recess therebetween; said second casing part having a generally planar wall with an inner face and a peripheral edge face, the planar wall of the second casing part extending over the shallow recess with the peripheral edge face frictionally engaging the rim inner face to assemble the casing parts together solely by friction fit, and the planar wall inner faces of the casing parts being spaced apart to define an internal cavity therebetween; one of the casing parts having a location post projecting into the internal cavity; and a weighted member located within the cavity to give the medal an appreciable weight, the weighted member having an aperture therein through which the location post closely extends so as to assist positive location of the weighted member within the cavity and the weighted member being shaped and sized so as to be sandwiched between the planar wall inner faces of the friction fitted casing parts thereby to be securely held solely by the casing parts against rattling within the cavity.

11. A medal consisting essentially of first and second casing parts composed of plastic material and assembled together to give an appearance of a unitary medal having a pair of spaced outer faces on which the medal can be decorated, the first casing part having a generally planar wall with an inner face and having an upstanding rim extending about the planar wall with an inner face, the inner faces of the planar wall and upstanding rim together defining a shallow recess therebetween, the first casing part also having a shoulder within the recess outstanding from the planar wall; the second casing part having a generally planar wall with an inner face and a peripheral edge face, the planar wall of the second casing part extending over the shallow recess with the peripheral edge face frictionally engaging the rim inner face to assemble the casing parts together solely by friction fit, and the planar wall of the second casing part abutting the shoulder so that the planar wall inner faces of the casing parts are spaced apart to define an internal cavity therebetween; one of the casing parts having a location post projecting into the internal cavity; and a heavy plate located within the cavity to give the medal an appreciable weight, the heavy plate having an aperture therein through which the location post closely extends so as to assist positive location of the heavy plate within the cavity, and the heavy plate being shaped and sized so as least substantially to fill the cavity and be sandwiched between the planar wall inner faces of the friction fitted casing parts thereby to be securely held solely by the casing parts against rattling within the cavity.

* * * * *